US008979593B2

(12) United States Patent
Lim et al.

(10) Patent No.: US 8,979,593 B2
(45) Date of Patent: Mar. 17, 2015

(54) LOW PROFILE ELECTRICAL CONNECTOR

(71) Applicant: Molex Incorporated, Lisle, IL (US)

(72) Inventors: Kian-Heng Lim, Singapore (SG); Han-Guan Tan, Singapore (SG)

(73) Assignee: Molex Incorporated, Lisle, IL (US)

( * ) Notice: Subject to any disclaimer, the term of this patent is extended or adjusted under 35 U.S.C. 154(b) by 121 days.

(21) Appl. No.: 13/894,882

(22) Filed: May 15, 2013

(65) Prior Publication Data

US 2013/0323980 A1 Dec. 5, 2013

(30) Foreign Application Priority Data

May 15, 2012 (CN) ..... 2012 1 0150832
May 15, 2012 (CN) ..... 2012 2 0218672 U

(51) Int. Cl.

| | |
|---|---|
| ***H01R 24/00*** | (2011.01) |
| ***H01R 12/73*** | (2011.01) |
| ***H01R 13/502*** | (2006.01) |
| ***H01R 13/6593*** | (2011.01) |
| *H01R 12/71* | (2011.01) |

(52) U.S. Cl.

CPC ..... *H01R 12/73* (2013.01); *H01R 13/502* (2013.01); *H01R 13/6593* (2013.01); *H01R 12/716* (2013.01)

USPC ..... 439/630; 439/329

(58) Field of Classification Search

USPC ..... 439/329, 630–632

See application file for complete search history.

(56) References Cited

U.S. PATENT DOCUMENTS

| | | | | |
|---|---|---|---|---|
| 6,083,018 | A * | 7/2000 | Hara et al. | 439/159 |
| 6,146,163 | A * | 11/2000 | Wu | 439/159 |
| 7,537,486 | B2 * | 5/2009 | Hong et al. | 439/626 |
| 7,833,063 | B2 * | 11/2010 | Matsumoto et al. | 439/630 |
| 7,896,670 | B1 | 3/2011 | Gao et al. | |
| 7,976,327 | B2 * | 7/2011 | Matsumoto et al. | 439/326 |
| 8,011,965 | B2 * | 9/2011 | Zhang | 439/630 |
| 2005/0159037 | A1 * | 7/2005 | Su et al. | 439/326 |
| 2010/0291785 | A1 * | 11/2010 | Chien et al. | 439/329 |
| 2011/0008985 | A1 * | 1/2011 | Matsumoto et al. | 439/329 |
| 2011/0151721 | A1 * | 6/2011 | Zhang | 439/630 |
| 2013/0157481 | A1 | 6/2013 | Soo | |

FOREIGN PATENT DOCUMENTS

CN 202906112 U 4/2013

* cited by examiner

*Primary Examiner* — Truc Nguyen
(74) *Attorney, Agent, or Firm* — Stephen L. Sheldon

(57) ABSTRACT

An electrical connector includes a metal shell and two terminal seats, the two terminal seats and the metal shell together define a mating slot. Each terminal seat having a first end portion and an opposite second end portion, the terminal seat including a housing, a metal frame and a plurality of terminals. The metal frame includes a bottom plate and two side plates. Each side plate includes a pivoting portion, each terminal seat is pivoted to the metal shell via the pivoting portions. The pivoting portion is positioned between the first end portion and the second end portion. The plurality of terminals are embedded in and fixed to the housing, each terminal includes a contact portion and a soldering portion, the contact portion extends into the mating slot, and the soldering portion is positioned at the first end portion.

12 Claims, 14 Drawing Sheets

LOW PROFILE ELECTRICAL CONNECTOR

RELATED APPLICATIONS

This application claims priority to Chinese Patent Application No. CN 201210150832.2, filed May 15, 2012 and to Chinese Patent Application No. CN 201220218672.6, filed May 15, 2012, both of which are incorporated herein by reference in their entirety.

TECHNICAL FIELD

The application relates to the field of connectors, more specifically to the field of connectors suitable for use in low-profile applications.

DESCRIPTION OF RELATED ART

User identification data of a mobile communication device are stored in a SIM (subscriber identity module) card, and the SIM card is connected to the mobile communication device with a SIM electrical connector. FIG. 1 illustrates a SIM card connector 1 in prior art, which is disclosed in a Singaporean patent application No. SG201106636-2. Generally, the SIM card connector 1 includes a terminal seat 10 and a metal shell 13. The metal shell 13 and the terminal seat 10 are assembled together to form a space receiving the SIM card. The terminal seat 10 includes a housing 11 and a plurality of terminals 12. The housing 11 is generally made from plastic, the plurality of terminals 12 are fixed to the housing 11 in an insert molding manner.

The metal shell 13 has a plurality of soldering points 131, and each terminal 12 has a soldering portion 121. When the SIM card connector 1 is mounted on a circuit board, the soldering point 131 and the soldering portion 121 are soldered on a corresponding soldering pad.

As shown in FIG. 1, the terminal seat 10 adopts a unitary design, and therefore, the terminal seat 10 has considerable length and width. Long and wide terminal seat 10 is easy to warp, so that it is difficult to ensure that the soldering points 131 of the metal shell 13 and the soldering portions 121 of the terminals 12 of the SIM card connector 1 are coplanar after the SIM card connector 1 is assembled.

In addition, a structure of the terminal seat 10 would change generally after reflow is performed, which would worsen situations of warping of the terminal seat 10 and non-coplanarity of the soldering points 131 of the metal shell 13 and the soldering portions 121 of the terminals 12.

SUMMARY

In view of above problems, the present application provides a new electrical connector. An embodiment of the present application provides an electrical connector, which includes a metal shell and two terminal seats, wherein the two terminal seats and the metal shell together define a mating slot. Each terminal seat includes a first end portion and a second end portion which are opposite, a housing, a metal frame and a plurality of terminals. The metal frame may be embedded in and fixed to the housing. The metal frame includes a bottom plate and two side plates. Each side plate includes a pivoting portion, each terminal seat is pivoted to the metal shell via the pivoting portions. The pivoting portion is positioned between the first end portion and the second end portion, and a distance from the pivoting portion to the first end portion is longer than a distance from the pivoting portion to the second end portion. The plurality of terminals are embedded in and fixed to the housing. Each terminal includes a contact portion and a soldering portion, the contact portion extends into the mating slot, and the soldering portion is positioned at the first end portion.

The depicted electrical connector has two terminal seats, therefore the terminal seats can be small and less likely to warp. The terminal seats are pivoted to the metal shell, and therefore, the soldering portions of the terminals can be adjusted relative to the metal shell.

BRIEF DESCRIPTION OF THE FIGURES

The present application is illustrated by way of example and not limited in the accompanying figures in which like reference numerals indicate similar elements and in which.

DESCRIPTION OF THE PREFERRED EMBODIMENTS

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity. Hereinafter embodiments of the present application will be described in details in combination with the drawings.

Figure 1:
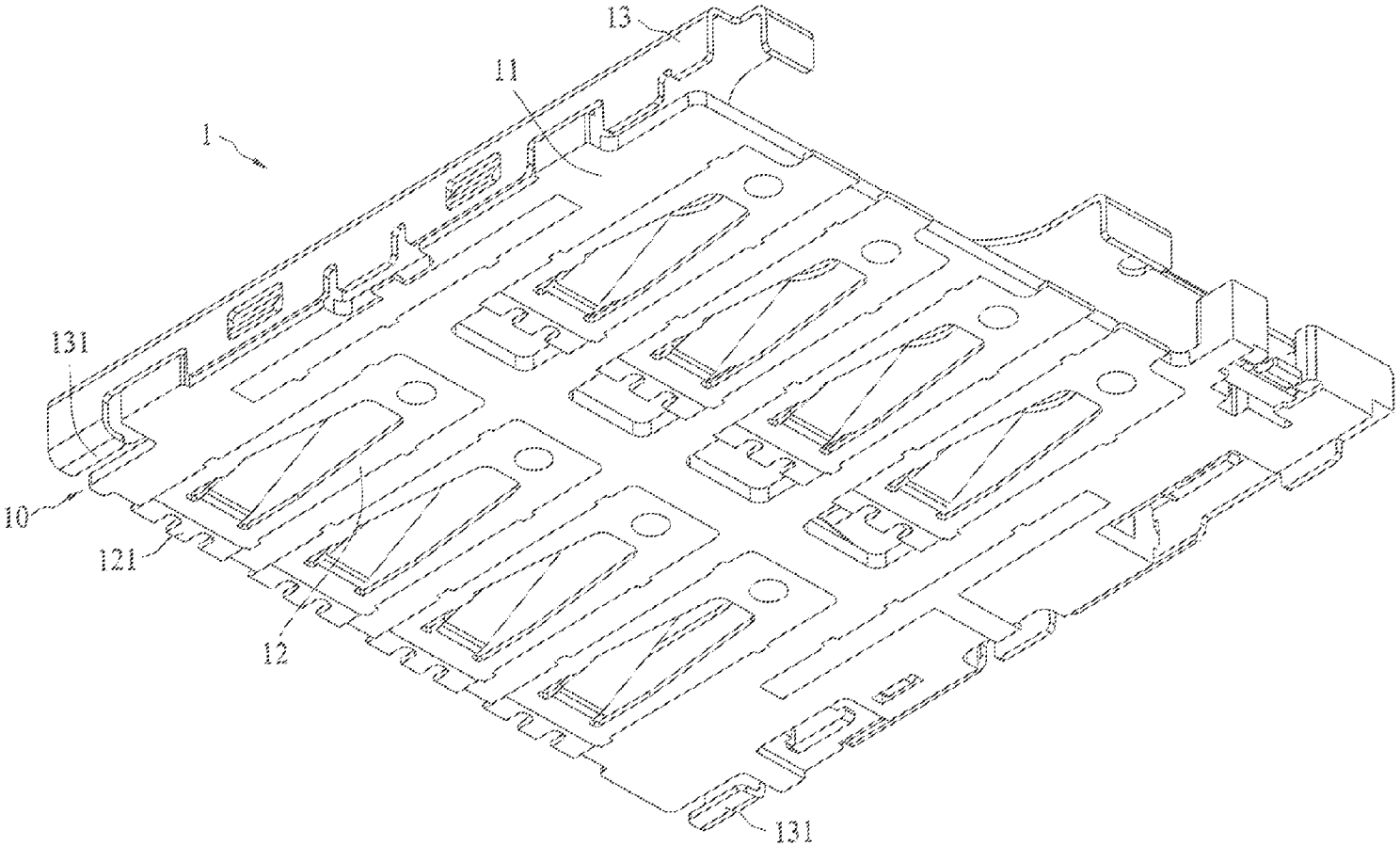
FIG. 1 shows a SIM card connector in prior art.
Figure 2:
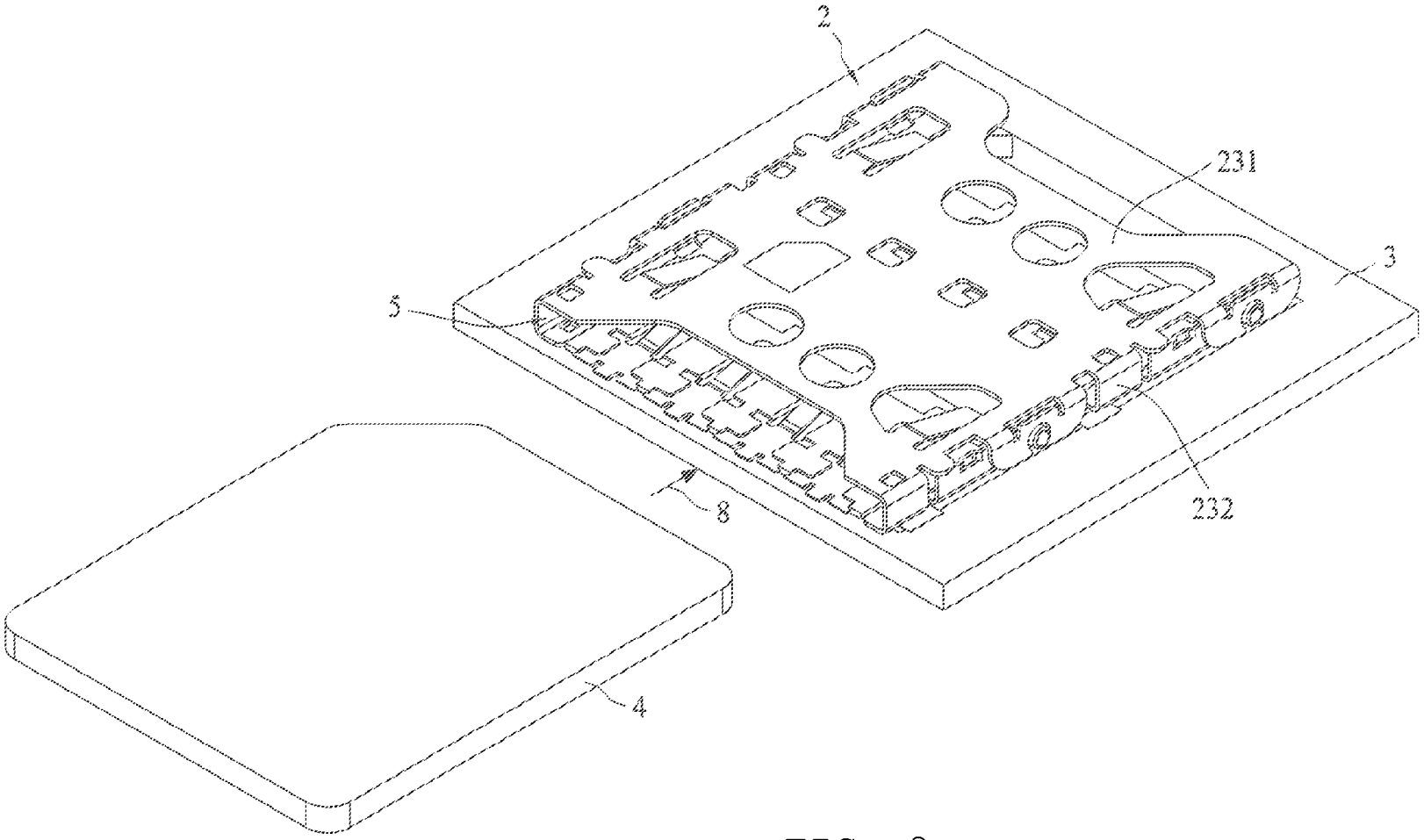
FIG. 2 is a view of an embodiment of an electrical connector and an electronic card provided on a circuit board.
Figure 3:
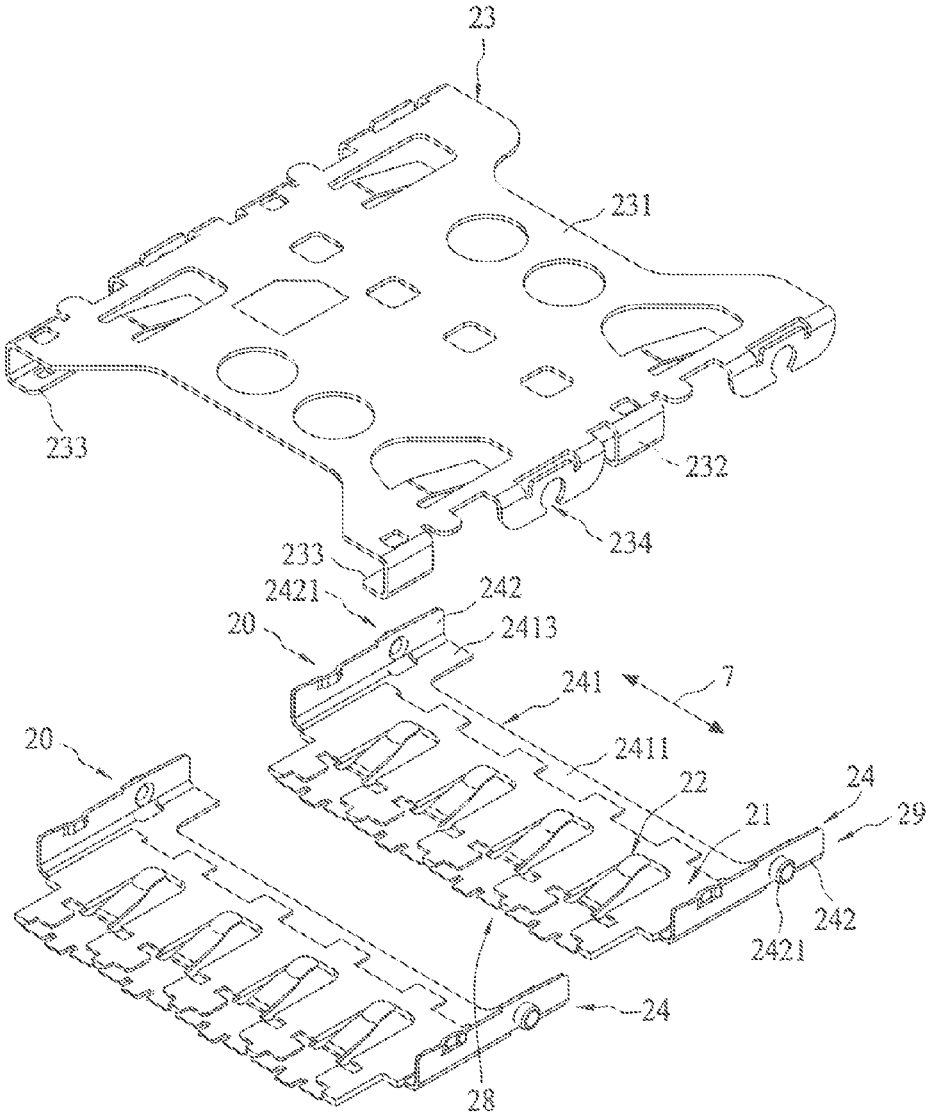
FIG. 3 is an exploded view of the electrical connector depicted in FIG. 2.
Figure 4:
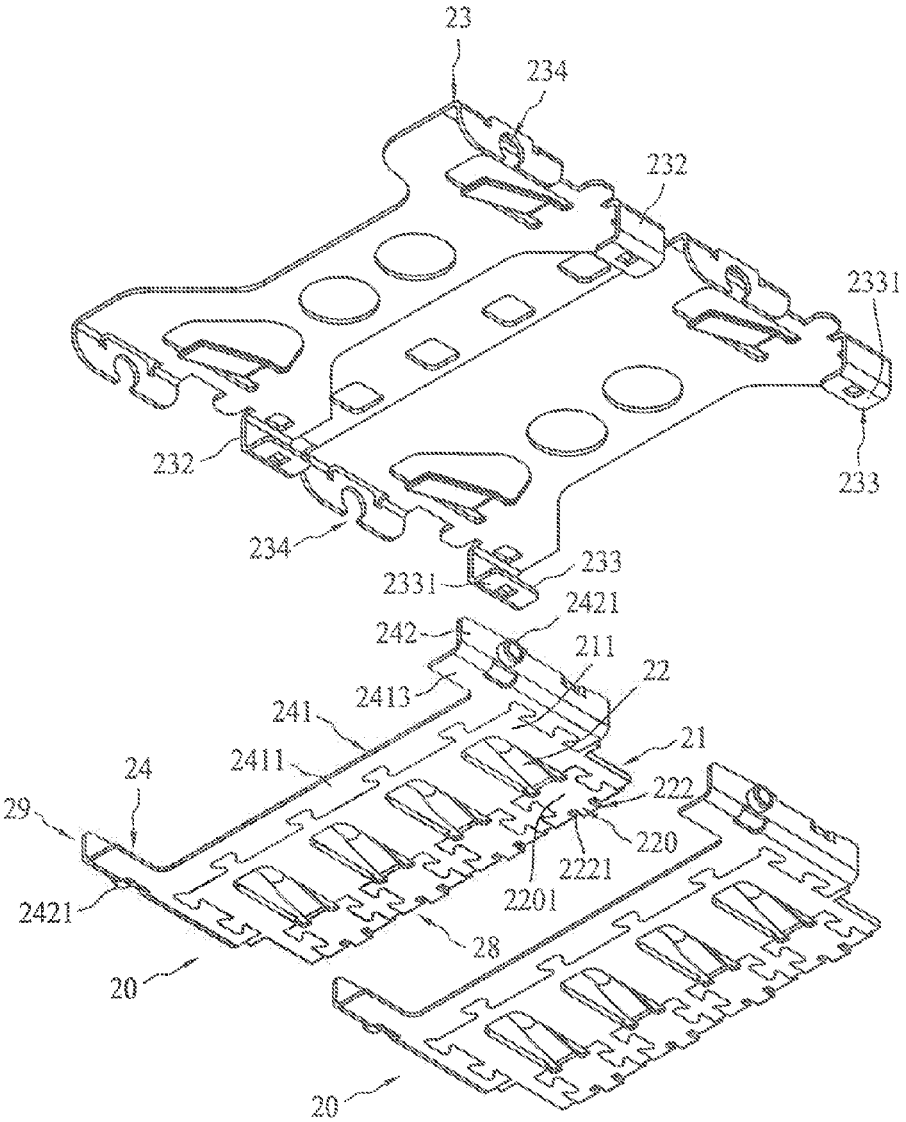
FIG. 4 is another exploded view of the electrical connector depicted in FIG. 2.

FIG. 2 is a view of an electrical connector 2 provided on a circuit board 3 and an electronic card 4 in an embodiment of the present application. FIG. 3 is an exploded view of the electrical connector 2 of FIG. 2. FIG. 4 is another exploded view of the electrical connector 2 of FIG. 2. Referring to FIGS. 2-4, an electrical connector 2 may be mounted on the circuit board 3 extending in a horizontal direction to receive an electronic card 4 (for example a SIM card). Although the present application takes a SIM card connector and the SIM card as an exemplary embodiment, the present application is not limited to them. The concept of the present application can be also applied to other electrical connectors.

The electrical connector 2 includes a metal shell 23 and a plurality of terminal seats 20. The metal shell 23 is positioned on the plurality of terminal seats 20, and the plurality of terminal seats 20 are connected to the metal shell 23 in a pivoting manner. The metal shell 23 and the plurality of terminal seats 20 together define a mating slot 5, and the electronic card 4 can be inserted into the mating slot 5 from a mating direction 8.

The metal shell 23 includes a top plate 231 and two side plates 232. The two side plates 232 are respectively positioned at two opposite sides of the top plate 231, therefore, two side plates 232 and the top plate 231 together form a receiving space which can receive the terminal seats 20. The metal shell 23 may comprise a plurality of soldering pieces 233, the plurality of soldering pieces 233 may be provided respectively in the two side plates 232. The soldering piece 233 may be bent and positioned below the receiving space. With the soldering pieces 233, the metal shell 23 may be soldered on the circuit board 3.

Referring to FIG. 3 and FIG. 4, each terminal seat 20 includes a first end portion 28 and a second end portion 29, the first end portion 28 and the second end portion 29 are opposite. Each terminal seat 20 may comprise a housing 21, a plurality of terminals 22, and a metal frame 24. The housing 21 may be formed of a resin, the metal frame 24 and the plurality of terminals 22 can be fixed to the housing 21 by an insert molding process so as to form the terminal seat 20, wherein the plurality of terminals 22 may be arranged in a transverse direction 7, and the transverse direction 7 may be perpendicular to the mating direction 8. In an embodiment, in each terminal seat 20, the metal frame 24 may be positioned at the second end portion 29 of the terminal seat 20.

Figure 5:
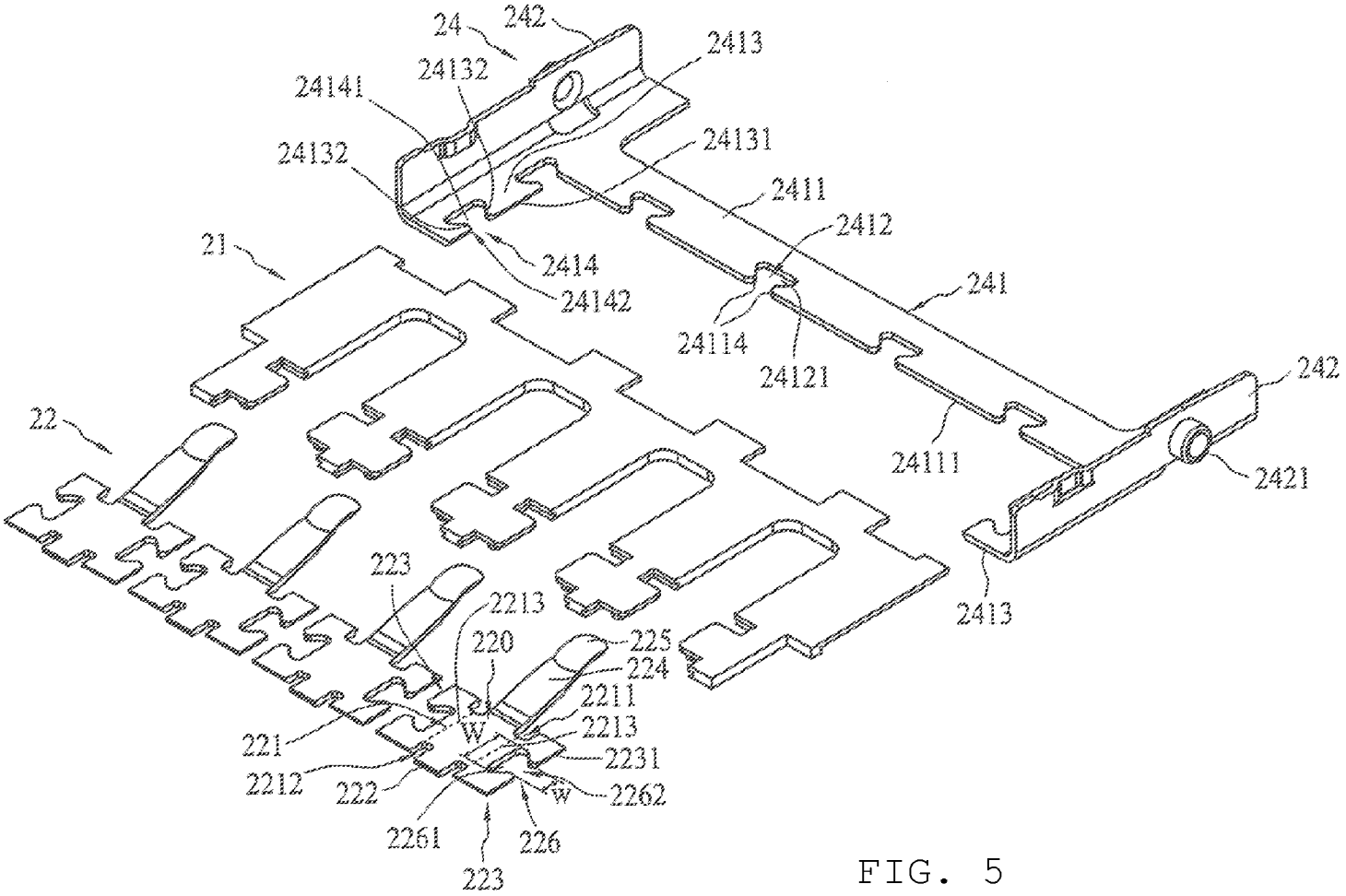
FIG. 5 is a perspective exploded view of an embodiment of terminals, an housing and a metal frame.

Referring to FIG. 5, the terminal 22 includes a flat plate portion 220, a soldering portion 222, a resilient arm 224, and a contact portion 225. The flat plate portion 220 includes a base 221 and two wing portions 223. The resilient arm 224 obliquely extends upwardly from a first end 2211 of the base 221. The contact portion 225 is formed at a distal end of the resilient arm 224, and may extend into the mating slot 5. The base 221 has a second end 2212, the second end 2212 may be opposite to the first end 2211, the soldering portion 222 extends from the second end 2212 of the base 221 and positioned at the first end portion 28. The two wing portions 223 extend laterally from two side edges 2213 of the base 221 respectively. Each wing portion 223 includes a hollow portion 226, the hollow portion 226 may comprise an middle portion 2261, and the hollow portion 226 extends toward an edge 2231 of the wing portion 223 and forms an opening 2262 at the edge 2231, wherein a width w of the opening 2262 is smaller than a width W of the middle portion 2261 in a direction parallel to a width direction of the opening 2262. After embedding, a part of the housing 21 fills in the hollow portion 226 to allow interlocking formed between each flat plate portion 220 and the housing 21, so as to allow the terminals 22 to be fixed to the housing 21.

As the design of the electrical connector 2 adopts the plurality of terminal seats 20, a length of the terminal seat 20 may be shortened in the mating direction 8 of the electronic card 4, so as to avoid obvious warping generated in the length direction and influencing coplanarity of the soldering pieces 233 of the metal shell 23 and the soldering portions 222 of the terminals 22. In addition, a mold required to manufacture the shorter terminal seat 20 is small, so as to reduce manufacturing cost. In an embodiment, the plurality of terminal seats 20 may be identical, so that the plurality of terminal seats 20 of the electrical connector 2 may be produced with the same mold, so as to reduce production cost.

Figure 7:
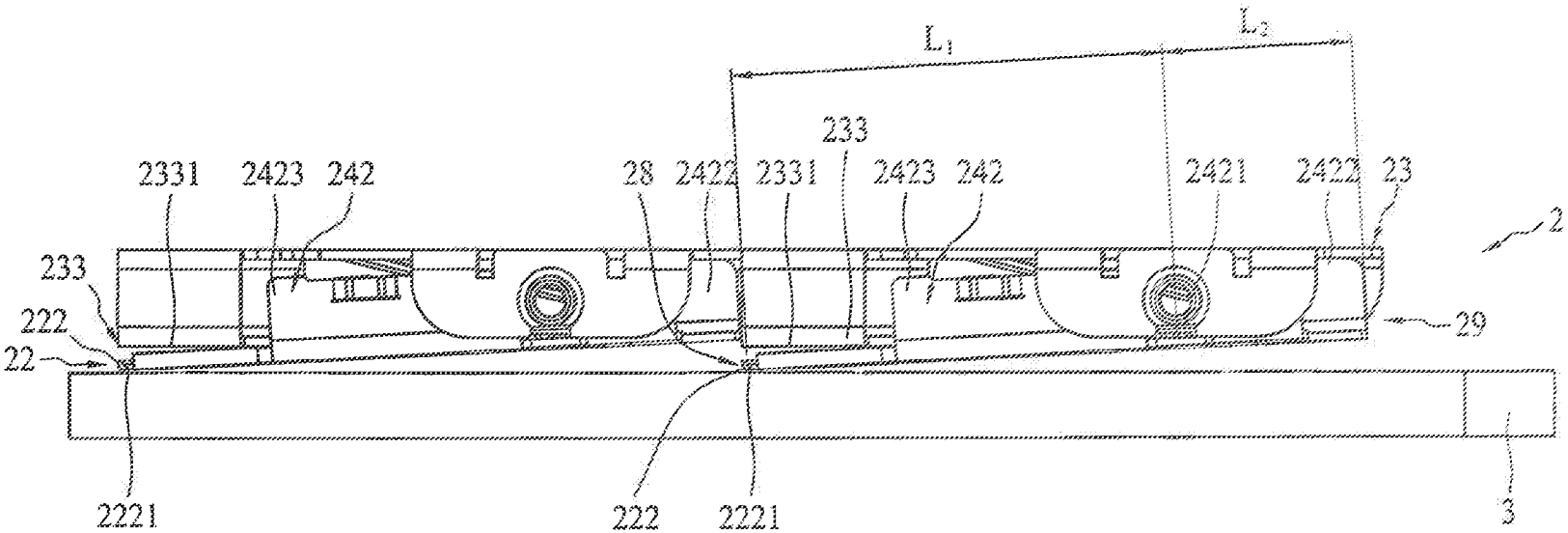
FIG. 7 is an elevated side view illustrating that the terminal seats of an electrical connector in a first position.

Referring to FIG. 3 and FIG. 4, the metal frame 24 includes a bottom plate 241 and two side plates 242. The two side plates 242 are provided at two opposite sides of the bottom plate 241 to define two sides of the mating slot 5. Each side plate 242 includes a pivoting portion 2421, wherein each terminal seat 20 is pivoted to the metal shell 23 via the pivoting portions 2421 of the side plates 242. Referring to FIG. 7, the pivoting portion 2421 of each side plate 242 may be positioned between the first end portion 28 and the second end portion 29 of the corresponding terminal seat 20. In an embodiment, a distance $L_1$ from the pivoting portion 2421 of each side plate 242 to the first end portion 28 of the terminal seat 20 is longer than a distance $L_2$ from the pivoting portion 2421 to the second end portion 29.

As shown in FIG. 3 and FIG. 4, in an embodiment, the pivoting portion 2421 may be a pivoting shaft transversely protruding outwardly from the corresponding side plate 242, and the side plate 232 of the metal shell 23 is provided with a corresponding pivoting hole 234 capable of allowing the pivoting shaft to rotate. The terminal seat 20 may pivot relative to the metal shell 23 to adjust the soldering portions 222 of the terminals 22 in an up-down direction relative to the soldering piece 233 of the metal shell 23, so as to allow compensation for coplanarity deviation between the soldering portions 222 of the terminals 22 and the soldering pieces 233 of the metal shell 23.

Figure 8:
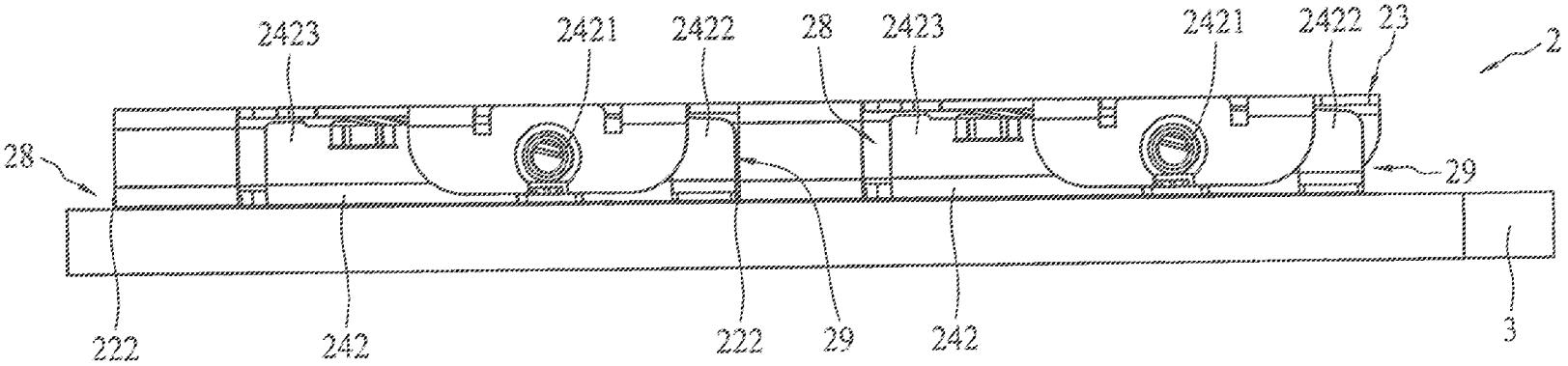
FIG. 8 is an elevated side view illustrating the terminal seats of the electrical connector of FIG. 7 in a second position.
Figure 9:
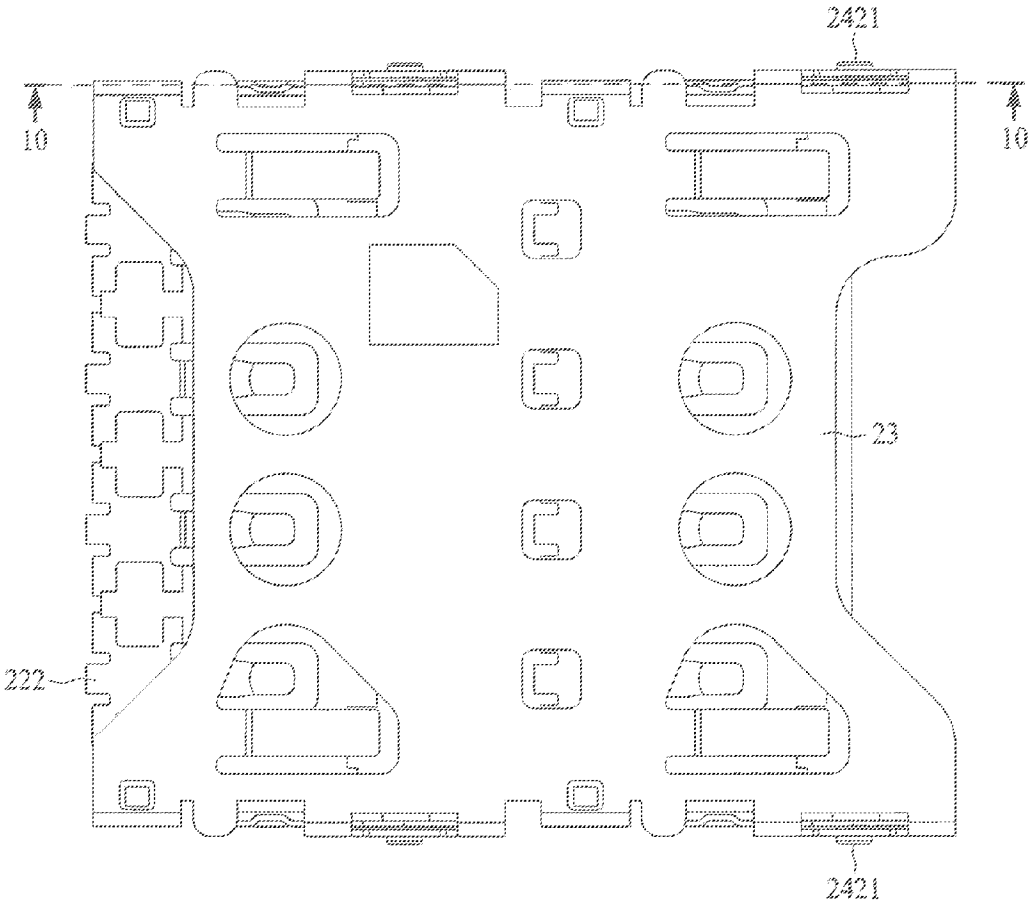
FIG. 9 is a bottom view of an embodiment of an electrical connector.
Figure 10:
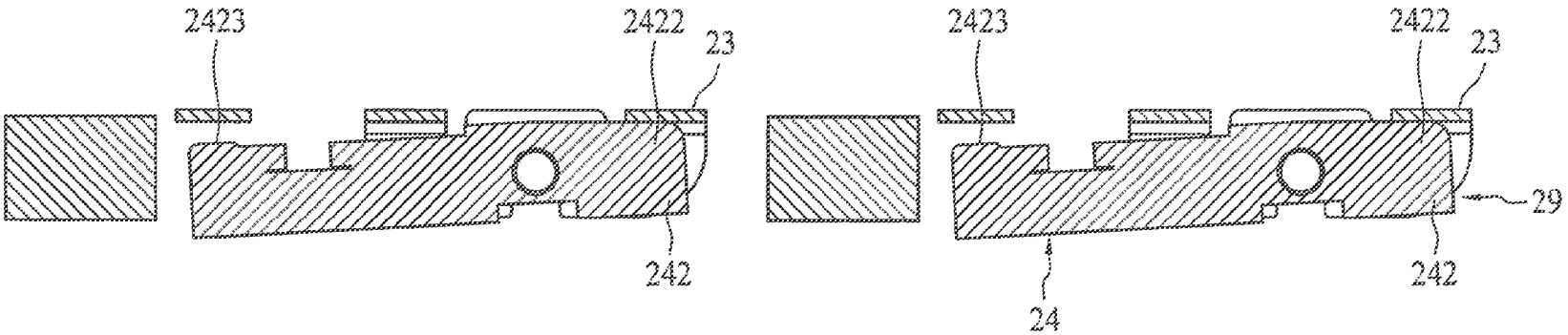
FIG. 10 is a cross-sectional view taken along a line 10-10 of FIG. 9.

Referring to FIGS. 7-10, the side plate 242 of the metal frame 24 may comprise a first stopping portion 2422, the first stopping portion 2422 may be close to the second end portion 29 of the terminal seat 20, and the first stopping portion 2422 may stop at the metal shell 23, as shown in FIG. 7 and FIG. 10. The side plate 242 of the metal frame 24 may further comprise a second stopping portion 2423, the second stopping portion 2423 may be close to the first end portion 28 of the terminal seat 20, and the second stopping portion 2423 may stop at the metal shell 23, as shown in FIG. 8.

Referring to FIG. 7 and FIG. 8, each terminal seat 20 may pivot between a first position (FIG. 7) and a second position (FIG. 8) relative to the metal shell 23. When the terminal seat 20 is in the first position, a soldering face 2221 of the soldering portion 222 of the terminal 22 would be lower than a soldering face 2331 of the soldering piece 233 of the metal shell 23. When the terminal seat 20 is in the second position, the soldering face 2221 of the soldering portion 222 of the terminal 22 would be flush with the soldering face 2331 of the soldering piece 233 of the metal shell 23.

Before the electrical connector 2 is mounted on the circuit board 3, as the pivoting portion 2421 is close to the second end portion 29 and the terminals 22 are close to the first end portion 28, the soldering portions 222 of the terminals 22 would droop downwardly until the first stopping portion 2422 of the side plate 242 stops at the metal shell 23. During a process of placing the electrical connector 2 on the circuit board 3, the soldering portions 222 of the terminals 22 would first contact respective soldering pads on the circuit board 3, during the subsequent placing process, the soldering portions 222 of the terminals 22 would continuously contact the respective soldering pads on the circuit board 3, finally the soldering pieces 233 of the metal shell 23 contact the respective soldering pads on the circuit board 3. It can be seen from that, a design that the terminal seat 20 may pivot relative to the metal shell 23 can ensure that both the soldering portions 222 of the terminals 22 and the soldering pieces 233 of the metal shell 23 can contact the respective soldering pads.

Figure 13:
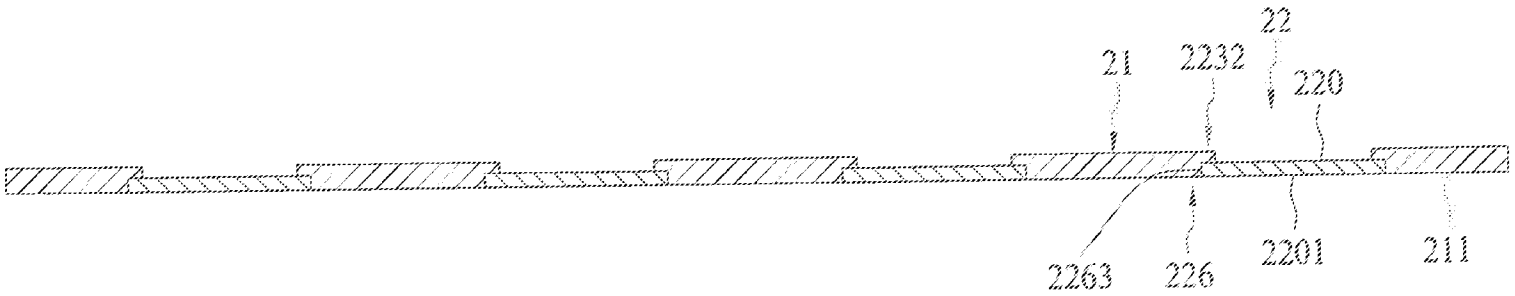
FIG. 13 is a cross-sectional view taken along a line 13-13 of FIG. 11.

Referring to FIG. 4, in an embodiment, the housing 21 includes a bottom face 211, the terminal 22 includes a flat plate portion 220, the flat plate portion 220 includes a bottom face 2201, wherein the bottom face 2201 of the flat plate portion 220 is flush with the bottom face 211 of the housing 21 (FIG. 13).

Referring to FIG. 5, the hollow portion 226 includes the opening 2262 at the edge 2231 of the wing portion 223 and the middle portion 2261 formed by extending into the wing portion 223, wherein the width w of the opening 2262 is smaller than the width W of the middle portion 2261. In an embodiment, the hollow portion 226 of the wing portion 223 is similar to a mortise of puzzle pieces. In an embodiment, the hollow portion 226 of the wing portion 223 includes a dovetail shape. That the wing portion 223 is provided with the hollow portion 226 may remedy a defect that the flat plate portion 220 is difficult to hold, and firmly hold the terminals 22 with the housing 21 so as to be not easily separated in the horizontal direction.

Figure 11:
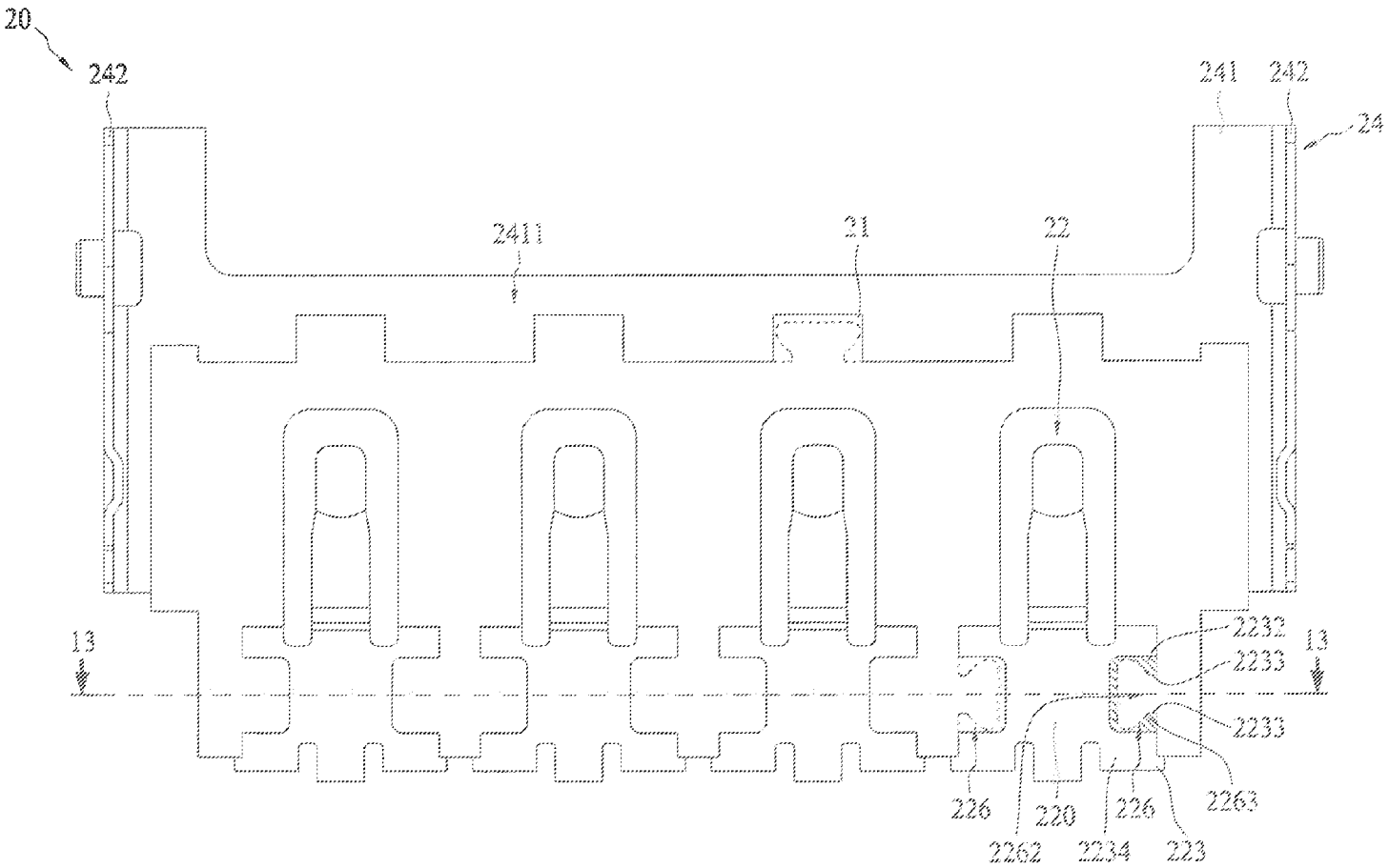
FIG. 11 is a bottom view of an embodiment of a terminal seat.
Figure 12:
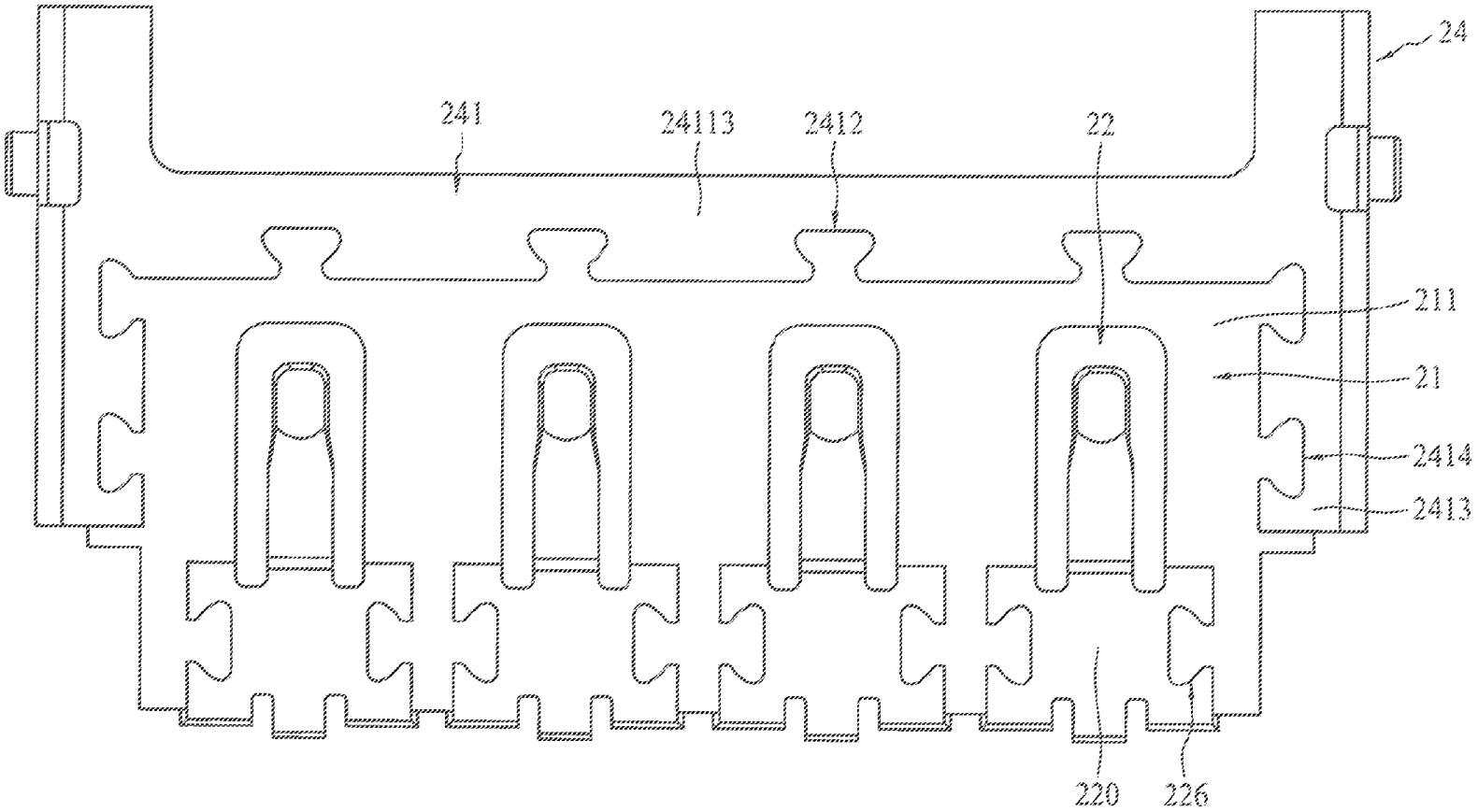
FIG. 12 is a top view of an embodiment of a terminal seat.
Figure 14:
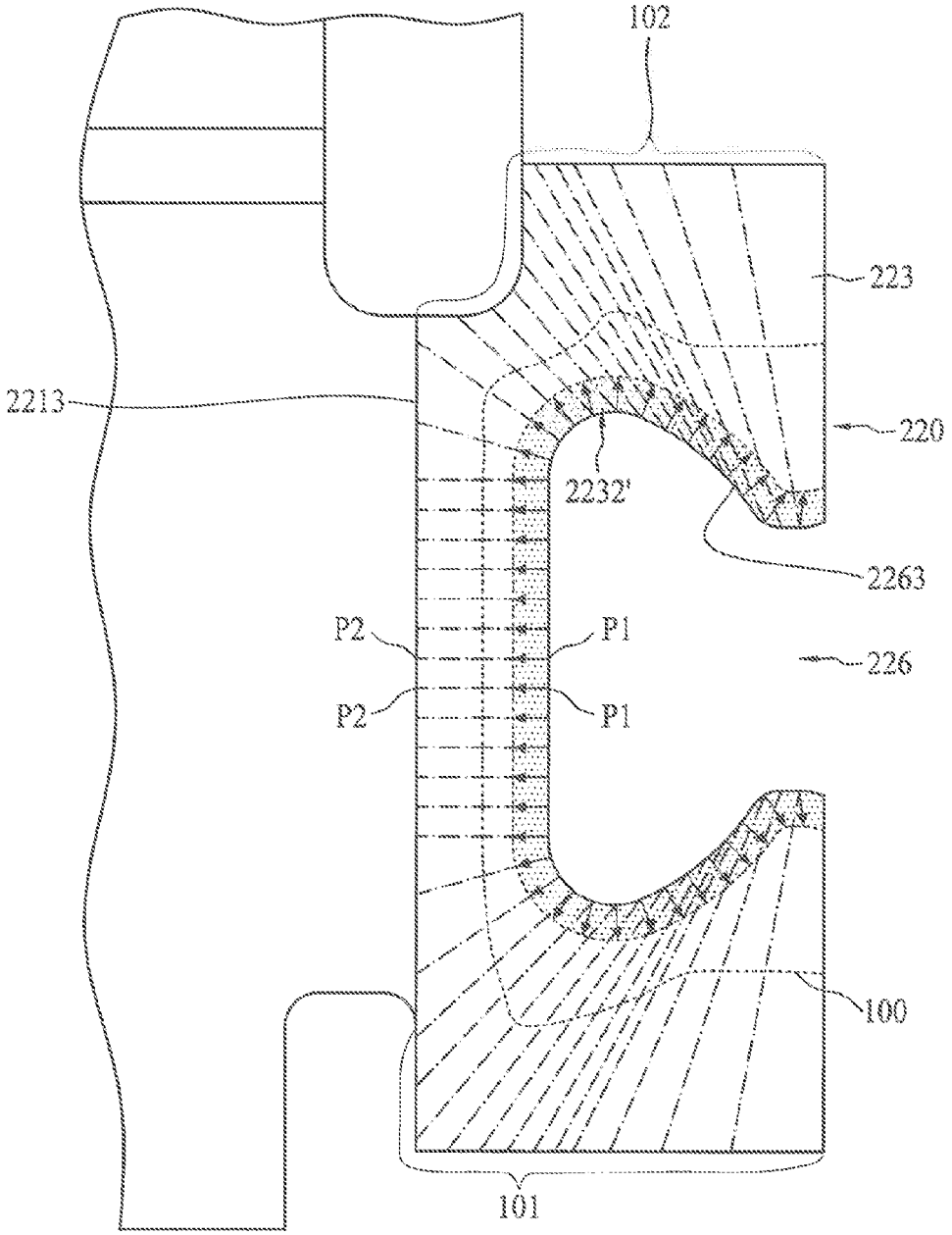
FIG. 14 is a top view of an embodiment of a peripheral edge region.

Referring to FIGS. 11-13, in order to increase a vertical and upward holding force, the hollow portion 226 of each wing portion 223 and a partial upper surface 2234 of each wing portion 223 are embedded in the housing 21. In an embodiment, each wing portion 223 has a peripheral edge region 2232, the peripheral edge region 2232 surrounds the hollow portion 226 along the edge 2263 of the hollow portion 226, wherein the hollow portion 226 of each wing portion 223 and the peripheral edge region 2232 of each wing portion 223 are embedded in housing 21. In other words, in an embodiment, a part of the housing 21 fills each hollow portion 226 and extends until to cover the peripheral edge region 2232 on the upper surface 2234 of each wing portion 223, in this way, a partial surface of each wing portion 223 may be exposed, which may reduce the housing 21 covering the terminal 22, so as to avoid warping of the terminal seat 20. In an embodiment, as shown in FIG. 14, a peripheral edge region 2232' may extend along the edge 2263 of the hollow portion 226 with an equal width, or expand outwardly from the edge 2263 of the hollow portion 226 with an equal distance (as shown with arrows in FIG. 14).

The peripheral edge region 2232 may be considered as a region expanding outwardly from the edge 2263 of the hollow portion 226 on the wing portion 223. In an embodiment, an area of the peripheral edge region 2232 does not exceed an exposed area of the wing portion 223 after the insert molding process. In an embodiment, the wing portion 223 can be two areas partitioned by a central line, wherein the peripheral edge region 2232 is positioned in one area, and more than half segments of the peripheral edge region 2232 do not expand to exceed the central line. In an embodiment, as shown in FIG. 14, the central line 100 may be determined by the following method. A plurality of first points P1 are determined on the edge 2263 of the hollow portion 226, a plurality of corresponding second points P2 are determined on edges (101 and 102) and the side edge 2213 of the wing portion 223. The plurality of first points P1 and the plurality of second points P2 are arranged in the same manner. In other words, if the plurality of first points P1 equally divide the edge 2263 of the hollow portion 226, the plurality of second points P2 also equally divide the edges (101 and 102) and the side edge 2213. Then, a midpoint of a connection line between the corresponding first point P1 and the second point P2 is determined. Finally, the central line 100 connecting a plurality of midpoints is determined.

Referring to FIG. 13, as the housing 21 extending from the hollow portion 226 only covers the peripheral edge region 2232 close to the edge 2263, so as to allow most part area of the flat plate portion 220 not to be covered by the housing 21, therefore, after injection and contraction, upper and lower sides of the flat plate portion 220 do not generate a too big difference caused by contraction of the housing material, so as to avoid warping of the terminal seat 20.

In an embodiment, as shown in FIG. 5 and FIG. 11, each wing portion 223 includes at least one clamping portion 2233, the at least one clamping portion 2233 defines an opening 2262, wherein the at least one clamping portion 2233 is embedded in the housing 21. In the present embodiment, each wing portion 223 includes two clamping portions 2233, wherein the two clamping portions 2233 are embedded in the housing 21.

Figure 6:
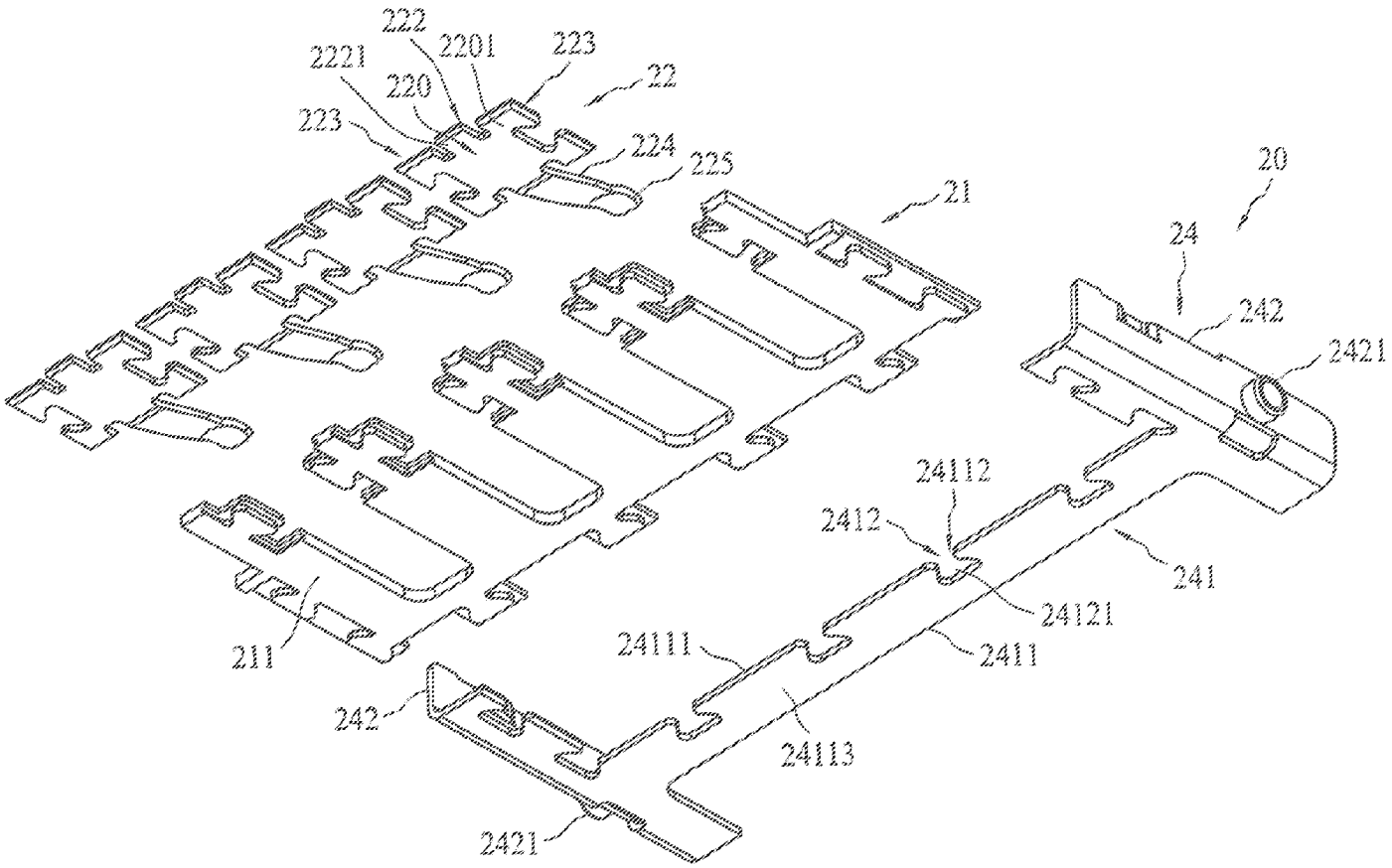
FIG. 6 is another perspective view of the embodiment depicted in FIG. 5.

Referring to FIG. 5 and FIG. 6, the metal frame 24 can be fixed to the housing 21 by the insert molding manner, thereby strengthening the housing 21. In an embodiment, the metal frame 24 includes a bottom plate 241 and two side plates 242. The bottom plate 241 includes two upright frames 2413 and a transverse frame 2411, wherein the two upright frames 2413 are respectively connected to the two side plates 242, and the transverse frame 2411 is connected to the two upright frames 2413. In another embodiment, the bottom plate 241 may not comprise the two upright frames 2413, wherein the transverse frame 2411 is connected to the two side plates 242.

The transverse frame 2411 may be provided with a plurality of hollow portions 2412, each hollow portion 2412 includes an middle portion 24121. Each second hollow portion 2412 extends toward an edge 24111 of the transverse frame 2411 and forms a second opening 24112 at the edge 24111 of the transverse frame 2411, wherein a width of the second opening 24112 is smaller than a width of the middle portion 24121 of the second hollow portion 2412 in a direction parallel to a width direction of the second opening 24112. In an embodiment, each opening 24112 is defined by at least one clamping portion 24114, wherein the at least one clamping portion 24114 is embedded in the housing 21.

Referring to FIG. 5, each upright frame 2413 includes a plurality of hollow portions 2414. Each hollow portion 2414 includes an middle portion 24141, each hollow portion 2414 extends toward an edge 24131 of the corresponding upright frame 2413 and forms an opening 24142 at the edge 24131, a width of the opening 24142 is smaller than a width of the middle portion 24141 in a direction parallel to a width direction of the opening 24142.

In an embodiment, each opening 24142 is defined by at least one clamping portion 24132, wherein the at least one clamping portion 24132 is embedded in the housing 21.

Referring to FIG. 11 and FIG. 12 as shown, in an embodiment, the transverse frame 2411 includes a bottom face 24113. After embedding, the bottom face 24113 may be flush with the bottom face 211 of the housing 21. In an embodiment, a part of the housing 21 fills each hollow portion 2412 and extends to cover a partial upper surface of the two upright frames 2413 and the transverse frame 2411. In another embodiment, the above described part of the housing 21 may further fill each hollow portion 2414 of the upright frame 2413. In an embodiment, similar to the above described wing portion 223, each hollow portion 2412 and a peripheral edge region surrounding each hollow portion 2412 on the upper surface of the transverse frame 2411 are embedded in the housing 21.

The electrical connector in the embodiments of the present application includes the plurality of terminal seats, wherein the terminal seat includes the housing and the terminals fixed to the housing. The design of the plurality of terminal seats is adopted so as to shorten the lengths of the terminal seats, so as to avoid a problem of poor coplanarity of the terminal soldering portions caused by warping of the housing which is caused by using long housing. The terminal seats are pivoted to the metal shell, in this way, a relative position between the soldering pieces of the metal shell and the soldering portions of the terminals can be adjusted in the up-down direction, so as to ensure that the soldering pieces of the metal shell and the soldering portions of the terminals can be properly soldered on the circuit board. In addition, the terminal includes the flat plate portion, and the flat plate portion includes the wing portion fixed to the housing and having the hollow portion. The part of the housing fills each hollow portion and extends to cover the partial upper surface of each wing portion, thereby avoiding warping of the terminal seat caused by non-uniform distribution of the housing material covered on upper and lower surfaces of the wing portions.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connector, comprising:

a metal shell;

two terminal seats, each terminal seat including a first end portion and a second end portion opposite the first end portion, a housing and a metal frame embedded in and fixed to the housing, the metal frame including a bottom plate and two side plates, each side plate including a pivoting portion, the pivoting portions being positioned between the first end portion and the second end portion, each terminal seat being pivotably attached to the metal shell via the pivoting portions, wherein a first distance from the pivoting portion to the first end portion is longer than a second distance from the pivoting portion to the second end portion and wherein the terminal seats and the metal shell define a mating slot; and a plurality of terminals embedded in and fixed to the housing, each terminal including a contact portion and a soldering portion, the contact portion extending into the mating slot, and the soldering portion being positioned at the first end portion of the respective terminal seat.

2. The electrical connector according to claim 1, wherein the side plate of the metal frame is provided with a first stopping portion adjacent the second end portion of the terminal seat, the first stopping portion ending at the metal shell.

3. The electrical connector according to claim 2, wherein the side plate of the metal frame is provided with a second stopping portion thereon at a position close to the first end portion of the terminal seat, the second stopping portion stops at the metal shell.

4. The electrical connector according to claim 3, wherein the pivoting portion of the metal frame is a pivoting shaft transversely protruding outwardly from the side plate, and the metal shell is provided with a corresponding pivoting hole.

5. The electrical connector according to claim 4, wherein the metal shell includes a top plate and two side plates.

6. The electrical connector according to claim 5, wherein the metal shell includes a plurality of soldering pieces.

7. The electrical connector according to claim 1, wherein the metal shell includes a plurality of soldering pieces with soldering faces and each terminal seat can pivot between a first position and a second position relative to the metal shell, wherein the first position has a soldering face of the soldering portion of the terminal supported by the terminal seat positioned lower than the soldering face of the soldering piece; and wherein the second position has the soldering face of the soldering portion of the terminal positioned flush with the soldering face of the soldering piece.

8. The electrical connector according to claim 7, wherein the metal frame is positioned at the second end portion of each terminal seat.

9. The electrical connector according to claim 1, wherein the housing includes a bottom face and each terminal includes a flat plate portion with a bottom face and the bottom face of the flat plate portion is flush with the bottom face of the housing, wherein the flat plate portion includes two wing portions, each wing portion being provided with a first hollow portion, the first hollow portion including a middle portion, the first hollow portion extending to an edge of the flat plate portion and forming a first opening at the edge, a width of the first opening being smaller than a width of the middle portion in a direction parallel to a width direction of the first opening and a first part of the housing filling each first hollow portion and extending to cover a partial upper surface of each wing portion.

10. The electrical connector according to claim 9, wherein the metal frame includes a bottom plate and two side plates, the bottom plate includes a transverse frame that is connected to the two side plates, the traverse frame having a bottom face, the bottom face of the transverse frame being flush with the bottom face of the housing, the transverse frame being provided with a plurality of second hollow portions, each second hollow portion includes a middle portion, each second hollow portion extending toward an edge of the transverse frame and forming a second opening at the edge of the transverse frame, a width of the second opening being smaller than a width of the middle portion of the second hollow portion in a direction parallel to a width direction of the second opening, a second part of the housing filling each second hollow portion and extending to cover a partial upper surface of the transverse frame.

11. The electrical connector according to claim 9, wherein the metal frame includes a bottom plate and two side plates, the bottom plate includes two upright frames and a transverse frame, the two upright frames being respectively connected to the two side plates, the transverse frame having a bottom face and further being connected to the two upright frames, the bottom face of the transverse frame being flush with the bottom face of the housing, the transverse frame is provided with a plurality of second hollow portions, each second hollow portion includes an middle portion, each second hollow portion extends toward an edge of the transverse frame and form a second opening at the edge of the transverse frame, a width of the second opening is smaller than a width of the middle portion of the second hollow portion in a direction parallel to a width direction of the second opening, a second part of the housing fills each second hollow portion and extends to cover a partial upper surface of the two upright frames and a partial upper surface of the transverse frame.

12. The electrical connector according to claim 11, wherein each upright frame includes a plurality of third hollow portions, each third hollow portion includes a middle portion, each third hollow portion extending toward an edge of the corresponding upright frame and forming a third opening at the edge of the corresponding upright frame, a width of the third opening being smaller than a width of the middle portion of the third hollow portion in a direction parallel to a width direction of the third opening, the second part of the housing filling each third hollow portion.

* * * * *